US011193354B2

(12) United States Patent
Tyshko et al.

(10) Patent No.: US 11,193,354 B2
(45) Date of Patent: Dec. 7, 2021

(54) MOTORS FOR DOWNHOLE TOOLS DEVICES AND RELATED METHODS

(71) Applicant: Baker Hughes, a GE company, LLC, Houston, TX (US)

(72) Inventors: Alexey Tyshko, Oklahoma City, OK (US); V. Lavrinenko, Houston, TX (US); Stewart Brazil, Houston, TX (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

(21) Appl. No.: 16/213,451

(22) Filed: Dec. 7, 2018

(65) Prior Publication Data

US 2020/0182021 A1 Jun. 11, 2020

(51) Int. Cl.
*E21B 41/00* (2006.01)

(52) U.S. Cl.
CPC ..... *E21B 41/00* (2013.01)

(58) Field of Classification Search
CPC ..... E21B 41/00; E21B 4/04
See application file for complete search history.

(56) References Cited

U.S. PATENT DOCUMENTS 5,233,274 A 8/1993 Honda et al.
6,433,991 B1 * 8/2002 Deaton ..... E21B 23/00 361/191
6,479,922 B2 11/2002 Iarochenko et al.
9,197,141 B2 11/2015 Petrenko et al.
2002/0074900 A1 6/2002 Yoon et al.
2006/0198742 A1 9/2006 Difoggio et al.
2009/0021113 A1 1/2009 Negishi et al.
2013/0333947 A1 12/2013 Hay et al.
2014/0077658 A1 3/2014 Petrenko et al.
2019/0390538 A1 * 12/2019 Frantz, III ..... E21B 34/08

FOREIGN PATENT DOCUMENTS

WO 2017082350 A1 5/2017

OTHER PUBLICATIONS

Carotenuto, R., et al., "Langevin Flexural Piezoelectric Motor Based on Stator Precessional Motion," Sensors and Actuators A: 113 (2004) 189-197.

(Continued)

*Primary Examiner* — Brad Harcourt
(74) *Attorney, Agent, or Firm* — Mossman Kumar & Tyler PC

(57) ABSTRACT

A motor includes one or more actuator, one or more one passive members, and one or more pushing members. The actuator(s) vibrate along a first axis. The vibrations vary a dimension of the actuator(s) as measured along the first axis. The passive member(s) rotate around a second axis that is substantially parallel to the first axis. The pushing member(s) are positioned between the actuator(s) and the passive member(s). The pushing member(s) are fixed to the actuator(s) and have a contact surface frictionally engaging and applying a mechanical force to the passive member (s). The pushing member(s) have an asymmetric rigidity along the first axis. The motor and a power consumer may be conveyed into a wellbore. The motor may be energized to supply mechanical power to the power consumer.

15 Claims, 10 Drawing Sheets

(56) References Cited

OTHER PUBLICATIONS

Lavrinenko, V. Dr., et al., Piezomotors, presentation Apr. 2, 2008.
Spanner, K., "Survey of the Various Operating Principles of Ultrasonic Piezomotors," White Paper for Actuator 2006.
Int'l Preliminary Report on Patentability in PCT/US2019/065020 dated Jun. 8, 2021 with Written Opinion and Int'l Search Report dated Apr. 6, 2020.

* cited by examiner

MOTORS FOR DOWNHOLE TOOLS DEVICES AND RELATED METHODS

FIELD OF THE DISCLOSURE

This disclosure pertains generally to devices and methods that supply mechanical power for downhole power consumers.

BACKGROUND OF THE DISCLOSURE

Exploration and production of hydrocarbons generally requires the use of various tools that are lowered into a borehole, such as wireline assemblies, drilling assemblies, measurement tools, valves, packers, and production devices. The present disclosure addresses the need to efficiently and reliably provide mechanical power to such tools.

SUMMARY OF THE DISCLOSURE

In aspects, the present disclosure provides a motor for supplying mechanical power to a power consumer. The motor may include at least one actuator, at least one passive member, and at least one pushing member. The at least one actuator is configured to vibrate along a first axis. The vibrations vary a dimension of the at least one actuator as measured along the first axis. The at least one passive member is configured to rotate around a second axis that is substantially parallel to the first axis. The at least one pushing member is positioned between the at least one actuator and the at least one passive member. The at least one pushing member is fixed to the at least one actuator and has a contact surface frictionally engaging and applying a mechanical force to the at least one passive member. A related method includes forming the above-described motor, conveying the motor and a power consumer into a wellbore, and supplying mechanical power to the power consumer using the motor.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

In aspects, the present disclosure provides motors for providing mechanical power to downhole tools. These tools may directly or indirectly use the mechanical power to rotate, extend, contract, compress, or otherwise manipulate one or more objects during a downhole operation. For the purposes of the present disclosure, such tools will be referred to as power consumers.

Figure 1:
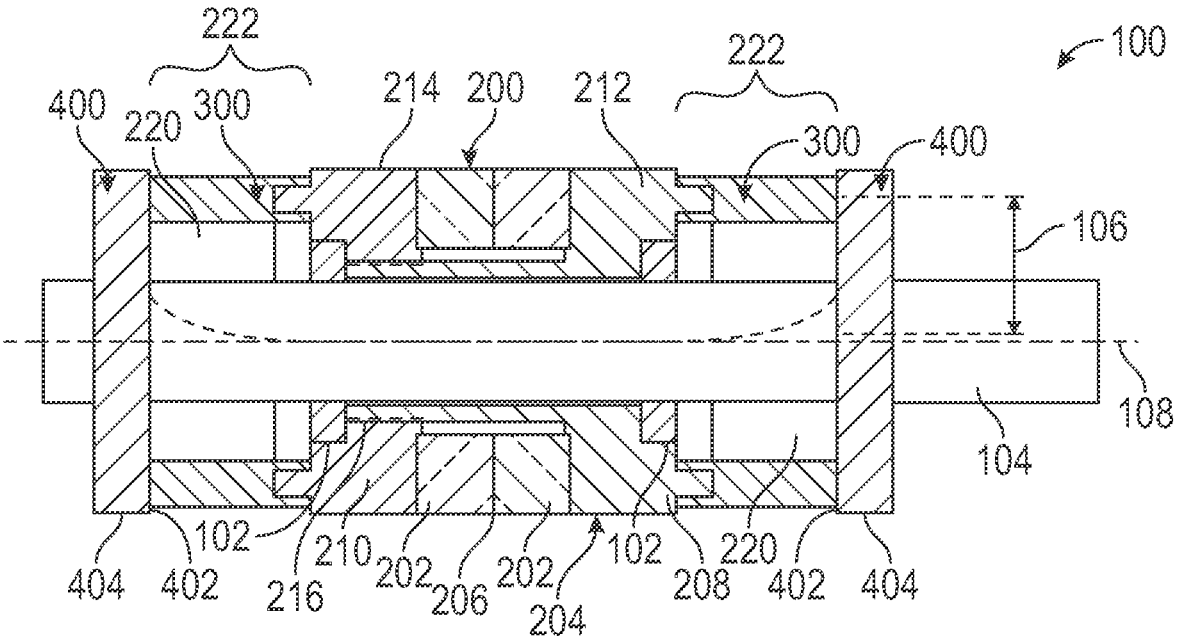
FIG. 1 schematically illustrates a side view of a motor according to one embodiment of the present disclosure.

Referring to FIG. 1, there is shown one non-limiting embodiment of a motor 100 according to the present disclosure. The motor 100 may include an actuator 200, one or more pushing members 300, and one or more passive members 400. In this arrangement, the motor 100 includes bearings 102 and an internal shaft 104. The passive members 400 may be disks or plates that are rigidly fixed to the internal shaft 104. Each passive member 400 has a contact face 402 that is non-parallel to a longitudinal axis 108 and an outer circumferential surface 404. The pushing members 300 contact the contact face 402 at a location radially inward of the outer circumferential surface 404. As will be discussed in greater detail below, the motor 100 generates torque using a frictional force applied to the passive members 400, which act on a moment arm 106 of the longitudinal rotational axis 108 around which the internal shaft 104 and passive members 400 rotate. The generated torque is used to directly or indirectly provide power for a power consumer (not shown).

The actuator 200 is configured to vibrate substantially along the longitudinal axis 108 and vary a dimension of the actuator 200 as measured along the longitudinal axis 108. By "substantially," it is meant that the magnitude of dimensional change along the longitudinal axis 108 is greater than the magnitude of dimensional change along any axis not parallel to the longitudinal axis 108. This may also be referred to as a "principal mode of vibration." In one non-limiting arrangement, the actuator 200 may include one or more signal responsive elements 202, a mandrel 204, and a suitable wiring assembly 206 electrically connected to the signal responsive elements 202.

The mandrel 204 may include telescopic members 208, 210, each of which have annular collars 212, 214, respectively. The telescopic members 208, 210 may be tubular members that slidingly engage at a mating portion 216 at which a portion of the telescoping member 208 is received within a bore of the telescopic member 210. The annular collars 212, 214 are radially enlarged bodies. An annular space 220 is defined between each collar 212, 214 and an adjacent passive member 400. An axial dimension 222 of the annular space 220 varies as the signal responsive elements 202 oscillate in axial length, i.e., expand and contract.

In one embodiment, the signal responsive elements 202 may be piezoelectric elements. Piezoelectric elements can change shape in response to an applied signal, such as an electrical signal. In particular, the signal responsive elements 202 increase and decrease length as measured along the longitudinal axis 108. The signal responsive elements 202 may be formed as ring members, which may be continuous or segmented. The signal responsive elements 202 are nested or captured between the collars 212, 214 such that an increase in axial length forces the annular collars 212, 214 to move away from one another, which is accommodated by the telescoping engagement of the members 208, 210 at the mating portion 216. When the piezoelectric elements are used for the signal responsive elements 202, then the actuator 100, which includes the signal responsive elements 202 and the mandrel 204, may be referred to as a "Langevin package."

In one non-limiting configuration, the actuator 200 may be configured to operate at a frequency that is one of a plurality of harmonic resonant frequencies of the actuator 200. That is, the shape, mass, and other physical attributes of the actuator 200 are selected such that an electrical signal, e.g., AC voltage, at a specified frequency, a "Langevin frequency" when piezoelectric material is used, causes a resonant vibration. Moreover, the resonant vibration causes a specified change in total axial dimension of the actuator 200.

Figure 2A:
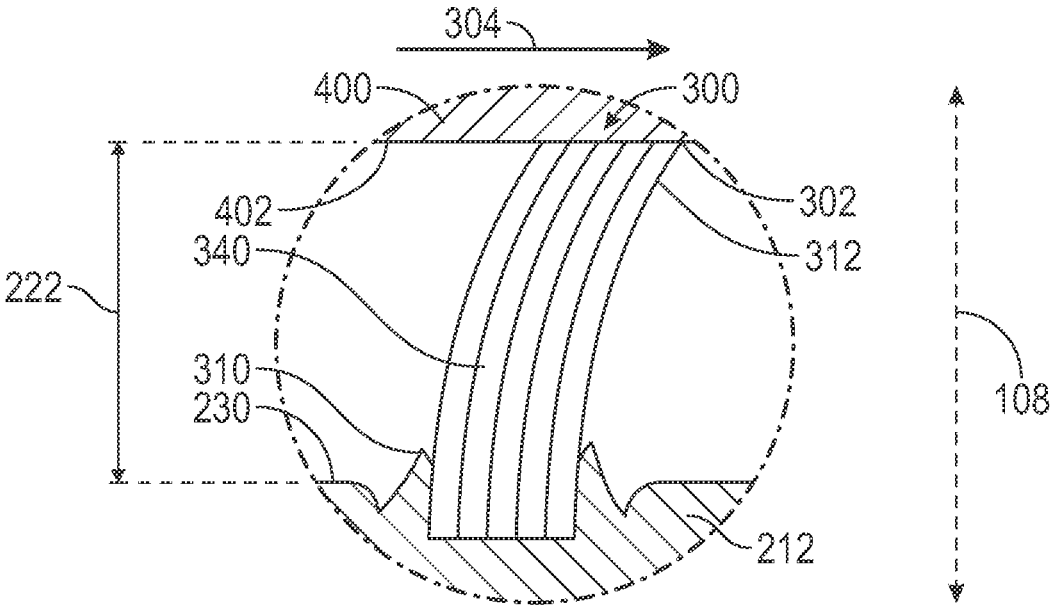
FIGS. 2A,B illustrate embodiments of pushing members according to the present disclosure.
Figure 2B:
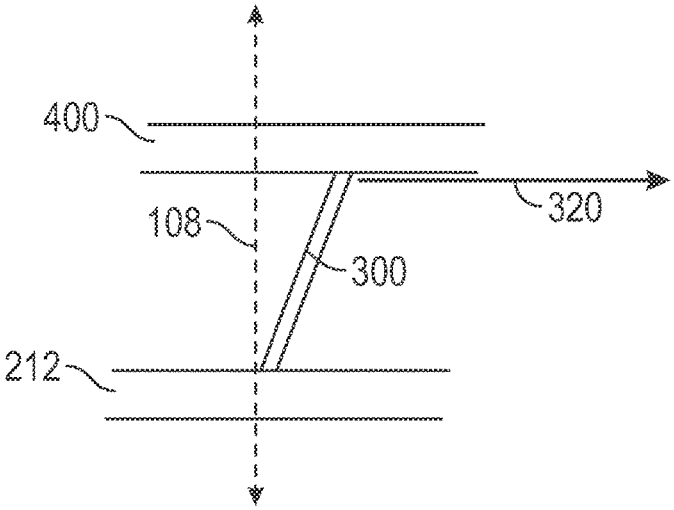

Referring to FIGS. 1 and 2A-B, the pushing members 300 are configured to generate a mechanical force to incrementally rotate the passive member(s) 400. The pushing members 300 are positioned between an annular collar 212, 214 and an adjacent passive member 400. For example, referring to FIG. 2A, in one arrangement, the pushing members 300 are fixed to the annular collar 212 and have a contact surface 302 frictionally engaging the adjacent passive member 400. The contact surface 302 may be region at or near a tip of the pushing member 300.

By "frictionally engaging," it is meant that the pushing members 300 physically contact a surface of a passive member 400 in a manner that relative movement between the pushing member 300 and the passive member 400 generates a frictional force that resists such relative movement and generates a tangential force 304 that can act on the moment arm 106 (FIG. 1). Additionally, the pushing member 400 has an asymmetric rigidity along the longitudinal axis 108. By "asymmetric rigidity," it is meant that the pushing member 400 is configured have different resistance to deformation, such as bending, depending on the vector of the force being applied to pushing members 300. The asymmetric rigidity generates different magnitudes of frictional forces applied to the passive member 400.

FIG. 2A illustrates one non-limiting embodiment of pushing members 300. The pushing members 300 may have a first end 310 fixed to an end face of an annular collar; e.g., an end face 230 of the annular collar 212. In this embodiment, the pushing members 300 are formed as plates or bars that project in a direction parallel to the longitudinal axis 108 and have a contact surface 302 that contact a contact face 402 of the passive member 400. Suitable pushing members 300 may be formed as rods, needles, posts, or other elongated members. Additionally, the pushing member 300 may include a pre-formed bent portion 340 such that some or all of the pushing member 300 is arcuate; i.e., curved. The bent portion 340 forms a pre-stress that resists further bending such that more resistance is encountered when the pushing member 300 is urged toward the passive member 400 than when the pushing member 300 moves away from the passive member 400. Thus, the normal forces and associated frictional forces applied to the passive member 400 are greater when the pushing member 300 is further bent than when the pushing member 300 relaxes. While only one set of pushing members 300 are shown, it should be understood that a plurality of sets of pushing members 300 may be circumferentially arrayed around the end face 230. The pushing members 300 at the collar 214 may be constructed in a similar or different fashion.

Referring to FIG. 2B, there is shown another embodiment of a pushing member 300. In this embodiment, the pushing member 300 is formed as a straight plate with no bent portion while in a relaxed state. The pushing member 300 has an angular offset relative to the longitudinal axis 108 so that contact with the adjacent passive member 400 generates a tangential force component 320.

Referring to FIG. 1, in an exemplary arrangement, the annular space or gap 222 separating the annular collar 212 and the end face 402 is selected to compress the pushing members 300 such that the pushing members 300 are always in a compressed state. Therefore, during operations, the pushing members 300 oscillate such that two different compressive forces are applied to the end face 402.

It should be understood that an asymmetric rigidity may also be obtained by varying material composition, surface treatments, or attached mechanical members that simulate a similar response as the bent portion 340. While five pushing members 300 are shown, embodiments may use greater or fewer number of pushing members 300. The pushing members 300 may be made of metal, such as stainless steel, or any other material having sufficient strength and modulus of elasticity to applying the required frictional force to the passive member 400.

Figure 3A:
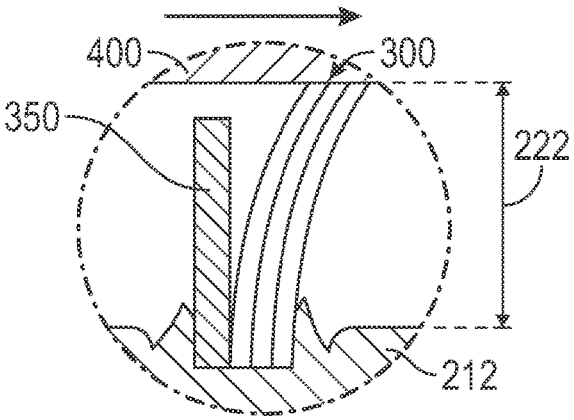
FIGS. 3A,B illustrate an embodiment of pushing members and support members according to the present disclosure.

Referring to FIGS. 3A,B, there is another embodiment of pushing members 300 in accordance with the present disclosure. In this arrangement, a support member 350 is disposed adjacent the pushing members 300. The support member 350 may increase the torque of rotation of the motor 100 by limiting bending of the pushing members 300 while assembling the motor 100. In one arrangement, the support member 350 may be thicker, shorter, and, therefore, more rigid than the pushing members 300. The support member 350 may also have a length that does not allow contact with the passive member 400, at least when functioning as intended. In other embodiments, the support member 350 may be made more rigid than the pushing members 300 by using different materials, bands or other bracing members, and/or surface features such as ribs.

Figure 3B:
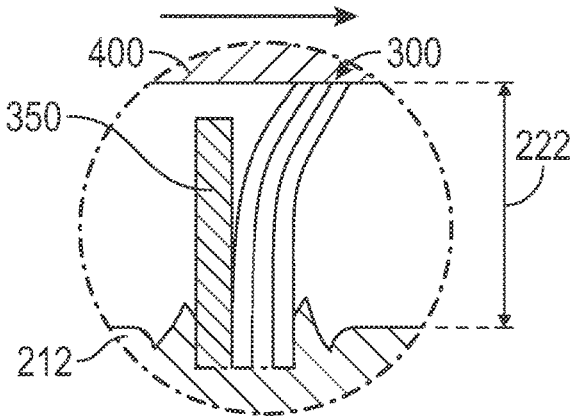

FIG. 3A shows the pushing members 300 in a pre-operating state wherein the gap 222 separating the passive member 400 and the collar 212 does not compress the pushing members 300 in a meaningful amount. In FIG. 3B, the gap 222 has been reduced to induce or increase a compressive force on the pushing members 300. The support member 350 acts as a stopping surface that limits the amount of bending of the adjacent pushing members 300 during the unbending. This may increase the compressive force, or spring force, in the pushing members 300, which in turns increases the frictional forces the pushing members 300 can generate on the passive members 400. Increasing the frictional forces can increase the generated torque.

Referring to FIG. 1, in an illustrative mode of operation, the motor 100 may directly or indirectly provide mechanical power to a power consumer (not shown) via the shaft 104. To begin operation, electrical power is transmitted to the signal responsive members 202 using the wiring assembly 206. The signal responsive members 202 vibrate at a selected frequency. The vibrations are manifested by physical deformation, i.e., expanding and contracting, along the longitudinal axis 108. The vibrations cause the gap 222 separating the annular collars 212, 214 and the adjacent passive members 400 to shrink and expand at the same frequency. These vibrations are at a frequency that induce a harmonic resonance in the actuator 200. When the gap 222 decreases in size, the pushing members 300 attached to the actuator 200 are further compressed and apply a first frictional force to the passive members 400, which acts on the moment arm 106 to generate torque that rotates the passive members 400 an incremental amount. When the gap 222 increases in size, the pushing members 300 attached to the actuator 200 are de-compressed and, while relaxing, apply a lower second frictional force to the passive members 400. However, this lower second frictional force is insufficient to rotate the passive member 400 in the opposite direction. Thus, continued oscillations incrementally rotate the passive members 400 and thereby provide power via the shaft 104 to the power consumer (not shown).

As discussed above, the actuator 200 vibrates and varies in dimension along the longitudinal axis 108. Notably, the passive members 400 rotate around the same longitudinal axis 108 or an axis that is substantially parallel to the longitudinal axis 108. By "substantially parallel," it is meant any angular offset between the two axes does not reduce the generated tangential force at the passive members 400 below the magnitude necessary to induce rotational movement of the passive members 400.

Referring to FIG. 1, another aspect of the motor 100 that should be appreciated is the relative ease in which the motor 100 may be assembled. In particular, because all of the components of the motor 100 are serially arranged, these components may be slid around the shaft 104. For example, once one passive member 400 is fixed, the first tubular member 208 and connected pushing members 300 may be slid onto the shaft 104. Next, in succession, the signal responsive members 202, the tubular member 212 and associated pushing members 300, and finally the opposing passive member 400 may be slid onto the shaft 104. Thereafter, the wiring assembly 206 may be attached. Thus, nearly all the assembly of the motor 100 requires merely the axial stacking of components.

The teachings of the present disclosure are susceptible to numerous embodiments, some non-limiting variants of which are discussed below.

Figure 4:
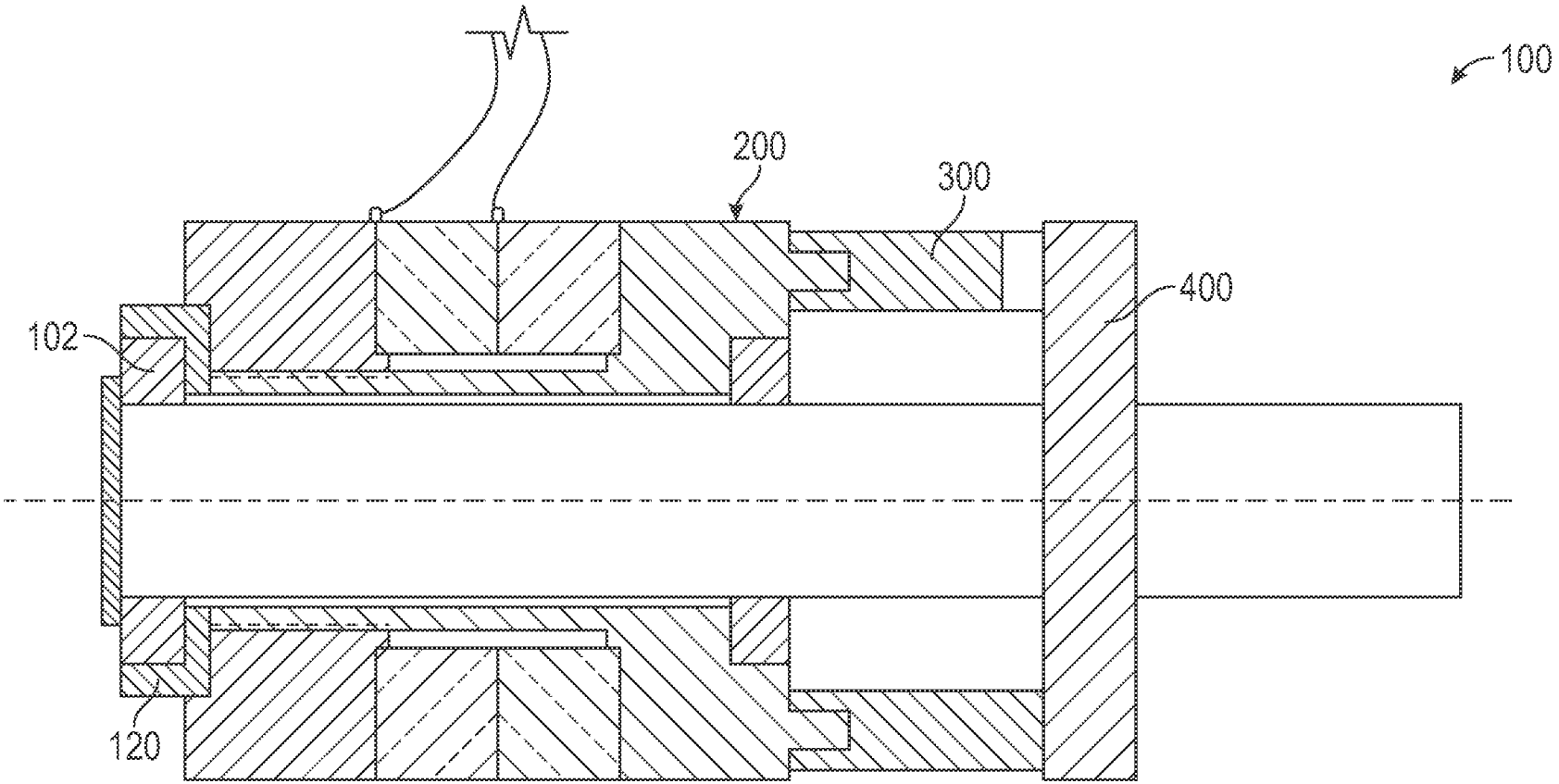
FIG. 4 schematically illustrates an embodiment of a motor according to the present disclosure that uses one passive member.

Referring to FIG. 4, there is shown a motor 100 that has one passive member 400 and one set of associated pushing members 300. One of the passive members has been replaced with a collar 120 that may enclose the bearing 102. Thus, during operation, only one passive member 100 is driven by the actuator 200. The collar 120 may be replaced with an adjustable pressure applicator, which is discussed in greater detail below.

Figure 5:
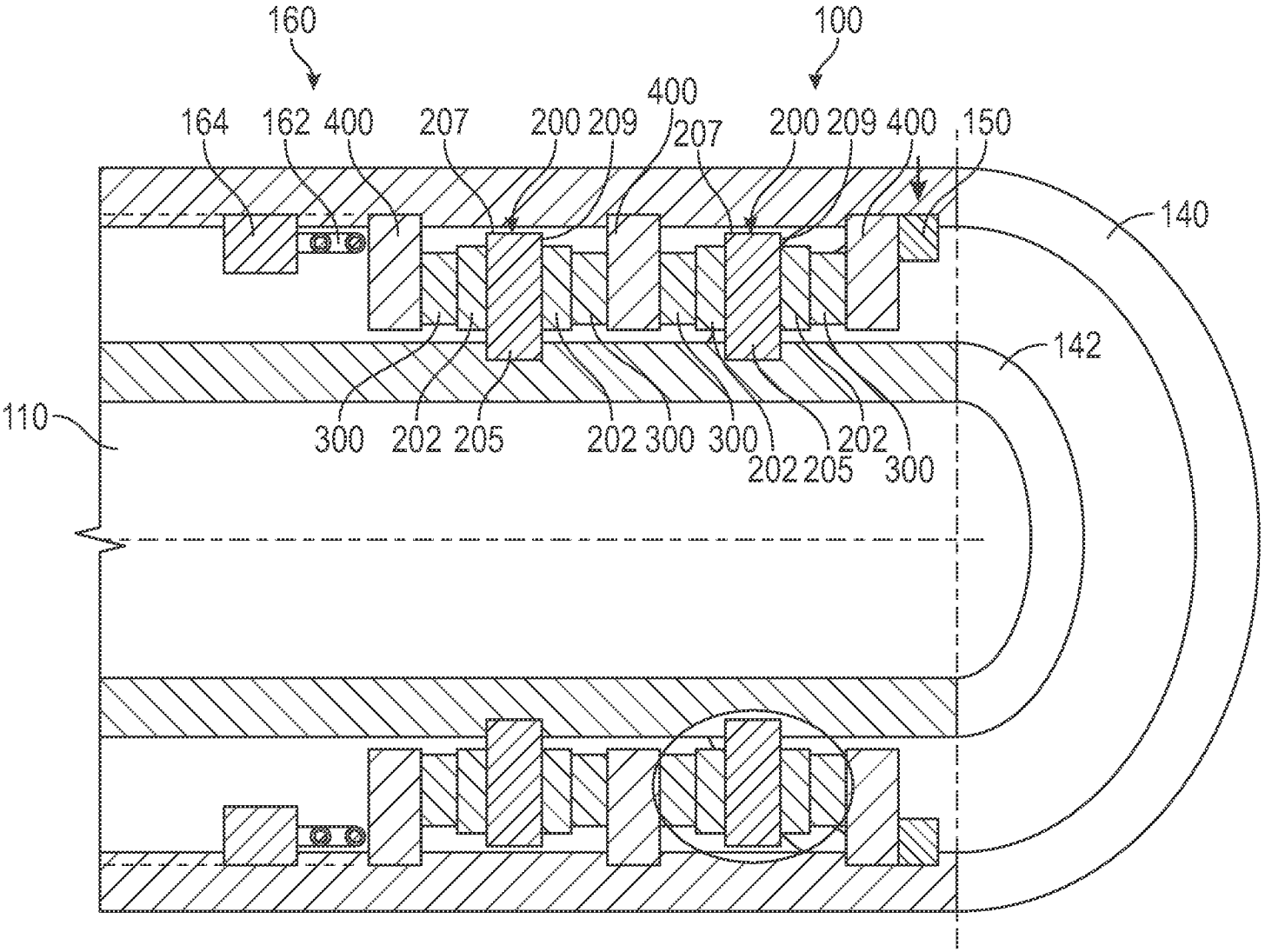
FIG. 5 shows a schematic of an embodiment of a motor according to the present disclosure that uses axially stacked actuators.

The FIG. 1 embodiment utilized one actuator 200. However, embodiments of the present disclosure may utilize two or more actuators 200, which is illustrated in FIG. 5. In FIG. 5, there is shown a sectional side view of a motor 100 positioned between a tool outer housing 140 and a tool inner housing 142. The tool inner housing 142 may have internal passage 110 that extends partially or completely through the motor 100. In some embodiments, the passage 110 may convey fluids, such as drilling fluids pumped from the surface and ejected out of a drill bit (not shown). In other embodiments, the passage 110 may be configured to house tools, instruments, or other components.

The FIG. 5 motor 100 may include a plurality of actuators 200, each having power washers 205, signal responsive members 202, and pushing members 300. The power washers 205 are fixed to the tool inner housing 142. The signal responsive members 202 and the pushing members 300 are fixed to opposing sides 207, 209 of each power washer 205. The pushing members 300 act on passive members 400, which are fixed to the tool outer housing 140.

Figure 6A:
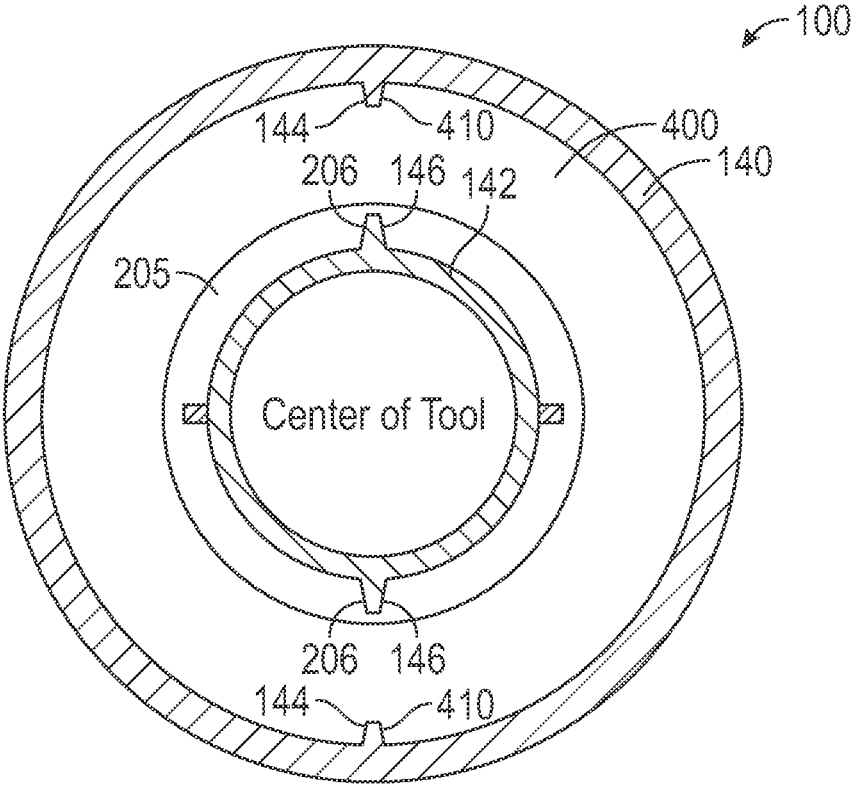
FIG. 6A illustrates an end view of an embodiment of a motor according to the present disclosure.

Referring to FIG. 6A, there is shown an end view of the motor 100. The tool outer housing 140 has one or more radially inwardly projecting keys 144 and the tool inner housing 142 has one or more radially outwardly projecting keys 146. The passive member 400 may be formed as a disk with one or more grooves 410 shaped complementary to the inwardly projecting keys 144. Thus, the passive member 400 may slide axially within the tool outer housing 140 without obstruction. However, the physical interference with the keys 144 during rotation allows torque transfer between the passive element 400 and the tool outer housing 140.

In a similar fashion, the power washers 205 may be a disk like member that mounts on the tool inner housing 142. The power washers 205 may include one or more grooves 206 shaped complementary to the outwardly projecting keys 146. Thus, the power washers 205 may slide axially on the tool inner housing 142 without obstruction. However, the physical interference with the keys 146 during rotation allows torque transfer between the power washers 205 and the tool inner housing 142.

Figure 6B:
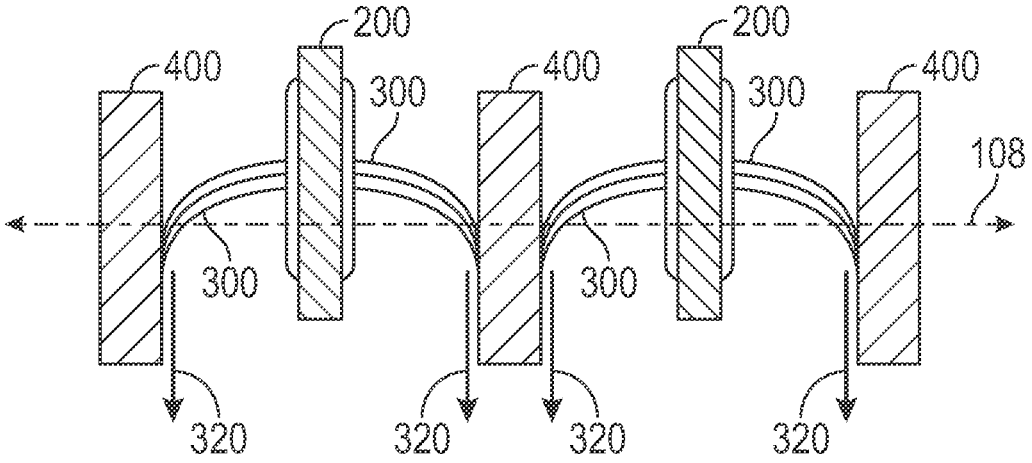
FIG. 6B schematically illustrates an arrangement of actuators, pushing members, and passive members according to one embodiment of the present disclosure.

Referring to FIG. 6B, the actuators 200, pushing members 300, and passive members 400 are shown in a simplified manner. The pushing members 300 are all bent to point in the same direction, which generates tangential forces 320 in the same direction. As in the FIG. 1 embodiment, the actuators 200 have a principal mode of vibration that is parallel, or aligned, to the longitudinal axis 108 and the passive members 400 rotate around the longitudinal axis 108, or an axis parallel to the longitudinal axis 108.

Referring to FIG. 5, the motor 100 may be secured between a stopper 150 and an adjustable pressure applicator 160. The stopper 150 may be a raised surface, a post, or other radially inwardly projecting feature that presents a stationary seating surface against which the stack of actuators 200 of the motor 100 may be compressed. The pressure applicator 160 may include a biasing element 162 and a locking element 164. The biasing element 162 may be a spring or other member that has the elastic properties to apply a spring force. The locking element 164 may be a selectively positionable body that urges the biasing element 162 against the outer most passive element 400. In one non-limiting arrangement, the locking element 162 may be a threaded ring. Displacing the locking element 164 toward the biasing element 162 compresses the biasing member 162 and increases a compressive pressure within the components of the actuators 200. In particular, this pressure is applied to the pushing members 300, which increases the frictional forces the pushing members 300 can generate at the passive members 400. Thus, the pressure applicator 160 can be used to adjust the pressure at the pushing members 300 and the frictional forces generated by the pushing members 300. It should be understood that the pressure applicator 160 may also be used in the motor embodiments illustrated in FIGS. 1 and 4.

Figure 7:
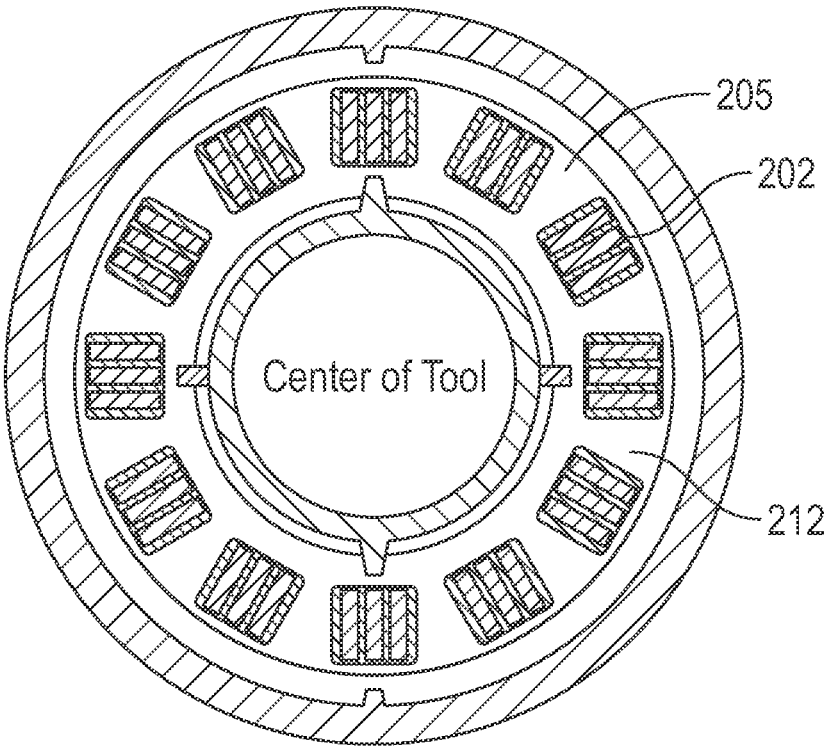
FIG. 7 illustrates an end view of a motor according to one embodiment of the present disclosure that uses mosaic signal responsive members.

Referring to FIG. 7, there is another end view of the motor 100. Rather than being a continuous circumferential body, the signal responsive elements 202 may be mosaic, i.e., discrete and separate circumferentially distributed sets of elements. The power washer 205 may have a face 212 on which the signal responsive elements 202 are fixed.

Referring to FIG. 5, it should be appreciated that while the number of actuators 200 and passive members 400 are increased relative to the FIG. 1 embodiment, the assembly is still relatively simple because all of the elements are axially stacked.

Figure 8A:
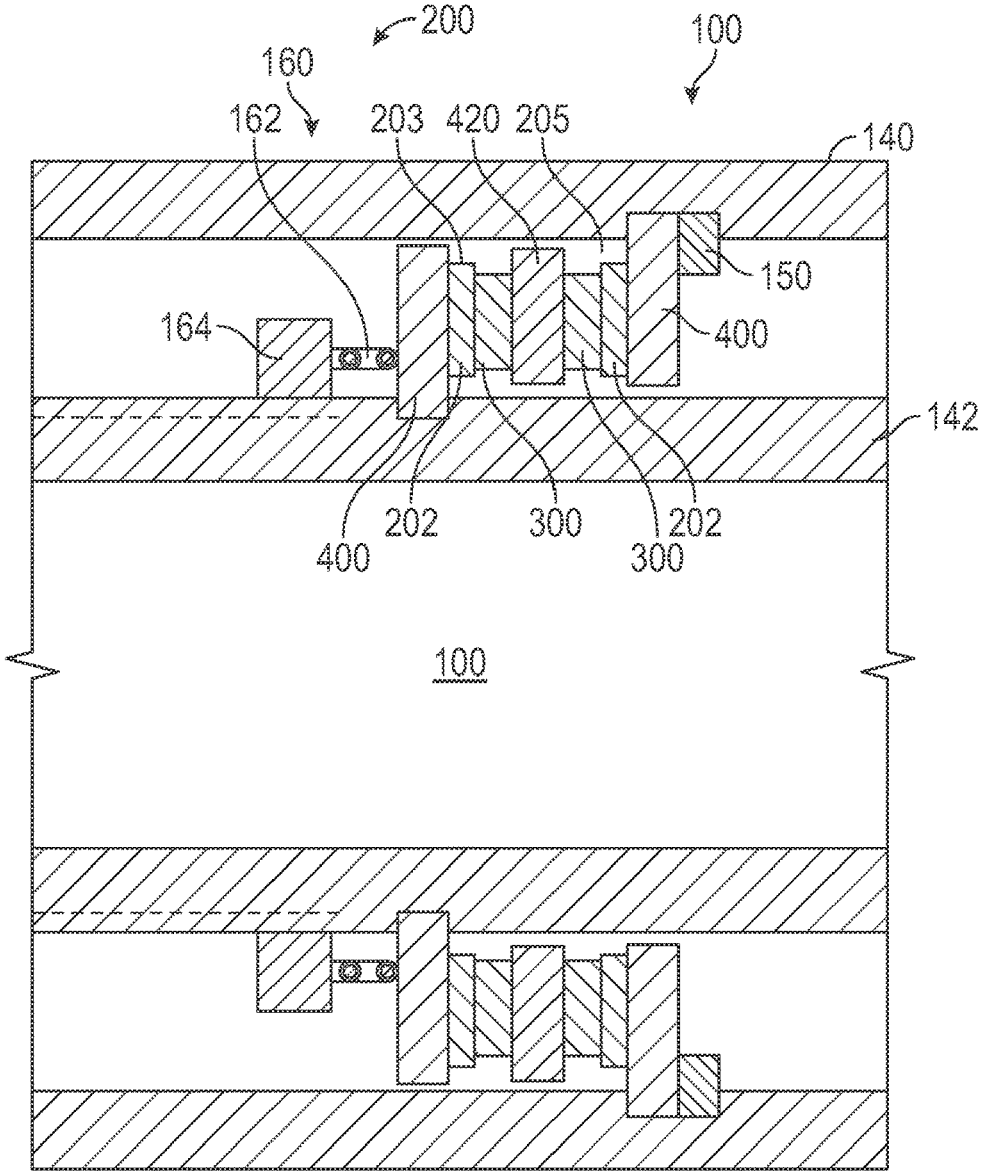
FIG. 8A schematically illustrates a reversible motor according to an embodiment of the present disclosure.

Referring to FIG. 8A, there is a side schematic sectional view of one embodiment of a motor 100 that can generate rotation in opposite directions, i.e., a reversible motor 100. As before, the motor 100 may be positioned in an annular area between a tool outer housing 140 and a tool inner housing 142. The passage 110 extends through the tool inner housing 142. The motor 100 may have two actuators 203, 205 and associated signal responsive elements 202 and pushing members 300. The motor 100 further includes a transfer member 420 that separates the actuators 203, 205. The transfer member 420 is compressively secured between the two sets of pushing members 300 and is not connected to either the tool outer housing 140 or the tool inner housing 142. The passive member 400 is fixed to the tool outer housing 140 and the other passive member 400 is connected to the tool inner housing 142. In some embodiments, the transfer members 420 only contacts the opposing pushing members 300.

Figure 8B:
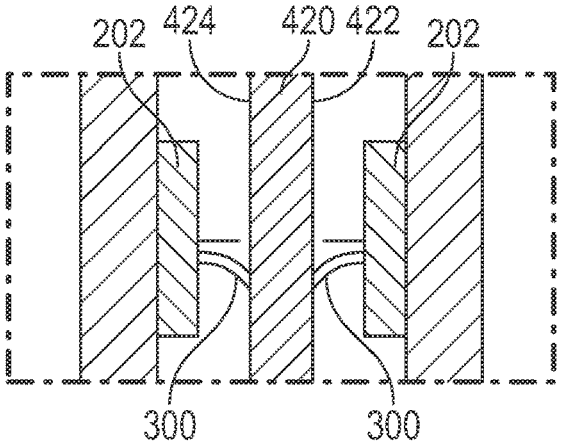
FIG. 8B schematically illustrates an arrangement of pushing members for the FIG. 8A embodiment.

As best seen in FIG. 8B, the signal responsive elements 202 and pushing members 300 of each actuator are oriented to act on opposing faces 422, 424 of the transfer member 420. Further, the pushing members 300 are bent or otherwise oriented to generate frictional forces in the same direction on the transfer member 420. In this embodiment, one actuator 205 is fixed to the tool outer housing 140 and the other actuator 203 is fixed to tool inner housing 142. The motor 100 may be secured between a stopper 150 and an adjustable pressure applicator 160. The stopper 150 may be a raised surface, a post, or other radially inwardly projecting feature that presents a stationary seating surface against which the actuators 200 of the motor 100 may be compressed. The adjustable pressure applicator 160 may include a biasing element 162 and a locking element 164 as described previously.

In an illustrative mode of operation for reversable rotation of the tool outer housing 140, the first actuator 203 may be energized by applying electrical power via the nodes (not shown) to the signal responsive elements 202 of the actuator 203. The frictional force generated by the attached pushing members 300 rotates the transfer member 420 in a first rotational direction. The frictional forces between the transfer member 420 and the pushing members 300 of the second actuator 205 are sufficiently high to keep the second actuator 205 and associated pushing members 300 stationary to the transfer member 420. Therefore, torque and rotation is transferred to the passive member 400, which rotates the tool outer housing 140. To rotate in the second, opposite direction, power is shut off to the actuator 203 and electrical power is applied via the nodes (not shown) to the signal responsive elements of the other actuator 205. In reverse operation, the actuator 203, which is stationary relative to the tool inner housing 142, holds the transfer member 420 due to frictional contact. Thus, the frictional force generated by the attached pushing members 300 rotates the actuator 205 in the second, opposite direction, which rotates the tool outer housing 140 in the same direction. When the tool outer housing 140 is fixed, the actuators 203, 205 can rotate the tool inner housing 142 in opposing directions in a similar manner.

Figure 9:
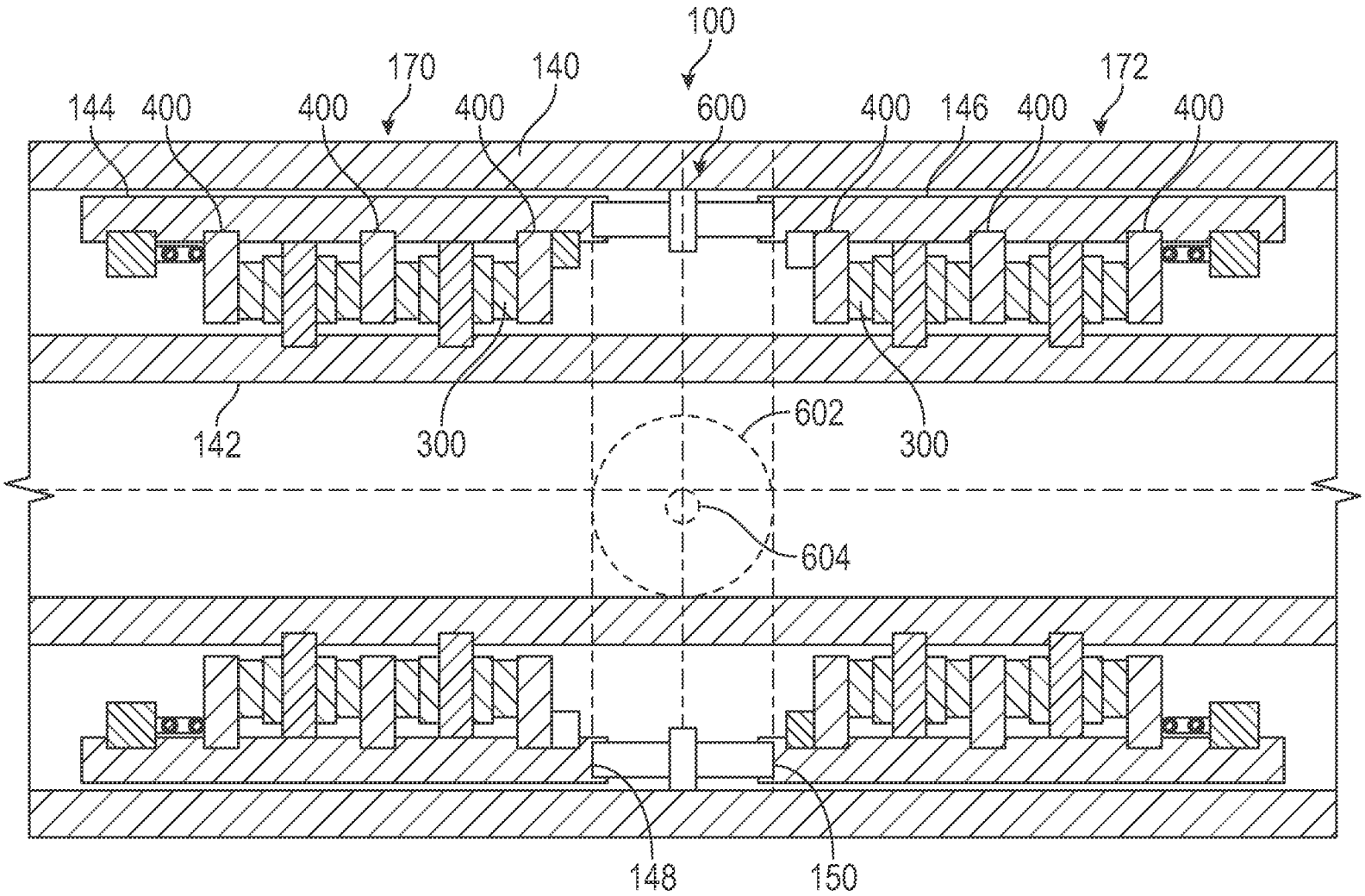
FIG. 9 illustrates schematically illustrates another reversible motor according to an embodiment of the present disclosure.

Referring to FIG. 9, there is shown another embodiment of a reversible motor 100. The reversible motor 100 may include a first motor module 170 and a second motor module 172. The motor modules 170, 172 may each be constructed as already described in connection with FIG. 5 and fixed to the tool inner housing 142. The pushing members 300 are shaped to generate frictional forces as described above. For clarity, only one pushing member 300 for each motor module 170, 172 is labeled. Additionally, instead of the passive members 400 being fixed to the tool outer housing 140 directly, the passive member 400 are connected to either of transfer tubes 144 and 146. A gear assembly 600 connects each transfer tube 144, 146 to the tool outer housing 140. Each transfer tube 144, 146 has an end face 148, 150, respectively, on which are formed gear teeth. The gear assembly 600 may include one or more gear elements 602 connected by an axle 604 to the tool outer housing 140. The gear elements 602 each have an outer circumferential surface on which are formed teeth complementary to the teeth on the end faces 148, 150.

In one mode of operation, electrical power is supplied to the first motor module 170, which rotates the transfer tube 144 in a first direction. However, the second motor module 172 remains stationary relative to the tool inner housing 142. Thus, the mating teeth of the end face 148 and the gear elements 602 cause the gear elements 602 to effectively roll on the stationary end face 150 of the second motor module 172 and also rotate in the same direction. The fixed connection between the gear elements 602 and the tube outer housing 140 transfers torque and thereby rotates the tube outer housing 140. To reverse rotation, power is terminated to the first motor module 170 and supplied to the second motor module 172. Now, the first motor module 170 remains stationary relative to the tool inner housing 142, which then enables rotation of the tool outer housing 140 in a similar manner.

The teachings of the present disclosure may be used in any phase of hydrocarbon exploration, drilling, evaluation, completion, and production. For purposes of illustration, several non-limiting embodiments of well tools using teachings of the present disclosure are described below.

Figure 10:
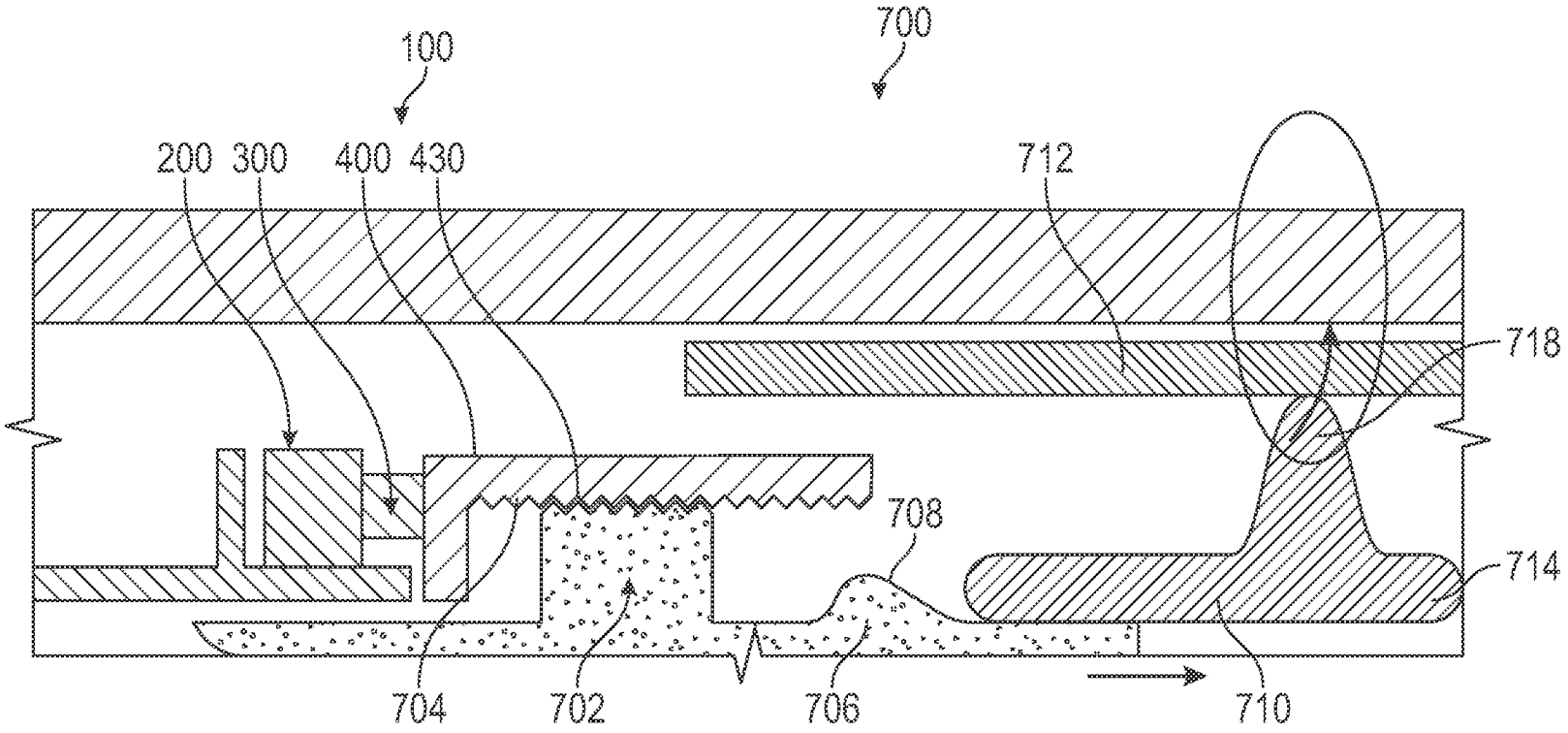
FIG. 10 schematically illustrates a motor according to the present disclosure that provides power for a downhole tool.

Referring to FIG. 10, there schematically illustrated a motor 100 for setting a tool 700 in a wellbore. The motor 100 may include an actuator 200 and pushing members 300 acting on a passive member 400. The passive member 400 may have a tubular portion in which is formed an inner threaded section 430. The tool 700 may include a translating member 702 that has an outer threaded section 704 and a wedge portion 706. The outer threaded section 704 is complementary to the inner threaded section 430. The wedge portion 706 may have an inclined surface 708. The translating member 702 may be formed as a tubular member. The tool 700 may also include a lever 710 that can be radially displaced to apply pressure to a wellbore tubular 712, which may be a liner hanger or other external structure.

In one mode of operation, the motor 100 is energized to rotate the passive member 400. The translating member 702 is configured to remain rotationally stationary. The direction of rotation is selected such that the thread profiles of the inner threaded section 430 and the outer threaded section 704 cause the translating member 702 to move axially away from the motor 100. This axial motion forces the wedge portion 706 to slide into engagement with the lever 710. Because the inclined surfaces 708 gradually increases the thickness of the wedge portion 706, the lever 710 is displaced radially outward. In some embodiments, the lever 710 may be pivot at a fulcrum 714 and have a contact portion 718 that presses into and deforms the wellbore tubular 712.

Figure 11:
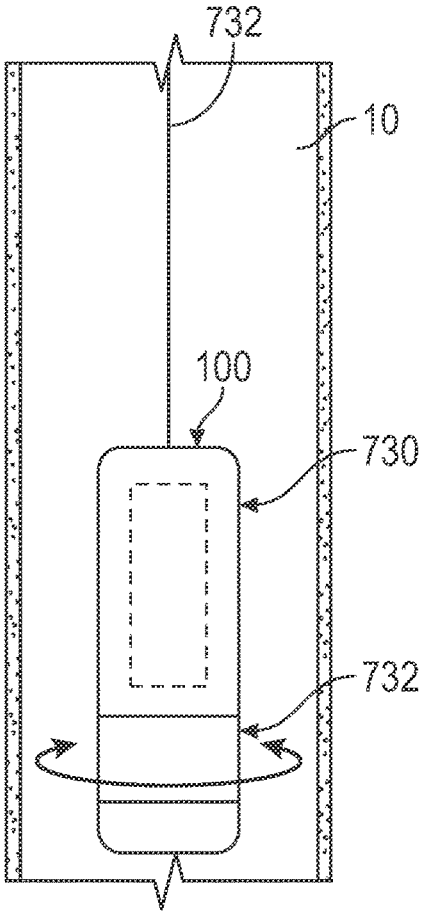
FIG. 11 schematically illustrates a motor according to the present disclosure that provides power for a downhole tool conveyed by a non-rigid carrier.
Figure 12:
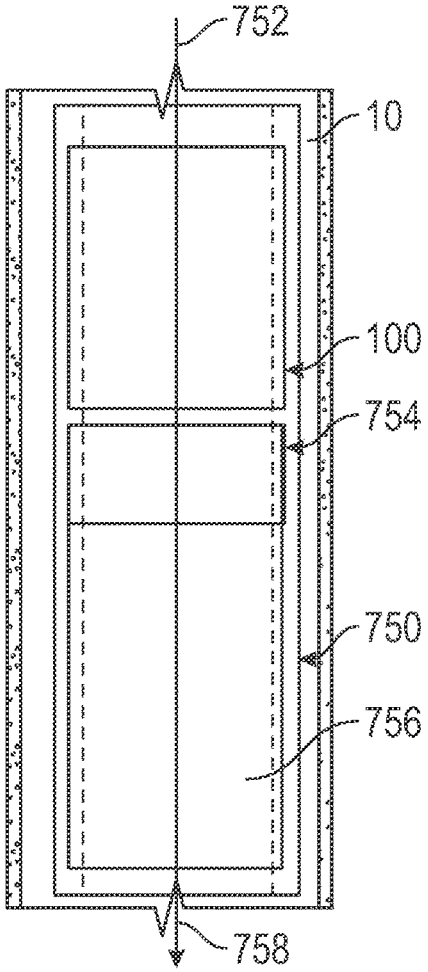
FIG. 12 schematically illustrates a motor according to the present disclosure that provides power for a downhole tool conveyed by a rigid carrier.

FIGS. 11 and 12 schematically illustrate embodiments of the present disclosure in other well construction related activities. In FIG. 11, a well tool 730 is conveyed into a wellbore 10 by a non-rigid carrier 732, such as a wire line (data and power), electric line (power only), or slickline. The well tool 730 may include a motor 100 to provide power to a power consumer 732, such as a rotating formation evaluation tool. The rotation may be uni-directional or bi-directional. In FIG. 12, a well tool 750 is conveyed into a wellbore 10 by a rigid carrier 752, such jointed drill pipe or coiled tubing. The well tool 750 may include a motor 100 to provide power to a power consumer 754. It should be noted that the rigid carrier 752 includes a flow bore 756 along which fluid 758 may flow. For example, a drilling fluid pumped from the surface may flow through the flow bore 756 to an exit such as a drill bit (not shown). As discussed previously, embodiments of the present disclosure may have passages that can allow such fluid flow.

Illustrative power consumers 732, 754 include, but are not limited to sensor sub, a bidirectional communication and power modules (BCPM), formation evaluation (FE) tools, rotary power devices such as drilling motors, steering devices, thrusters, stabilizers, centralizers, coring tools, etc. Steering devices may include radially extendable pads that engage a surrounding bore hole wall. Other steering devices may include adjustable bent subs. Sensor subs may include sensors for measuring near-bit direction (e.g., BHA azimuth and inclination, BHA coordinates, etc.) and sensors and tools for making rotary directional surveys.

Figure 13:
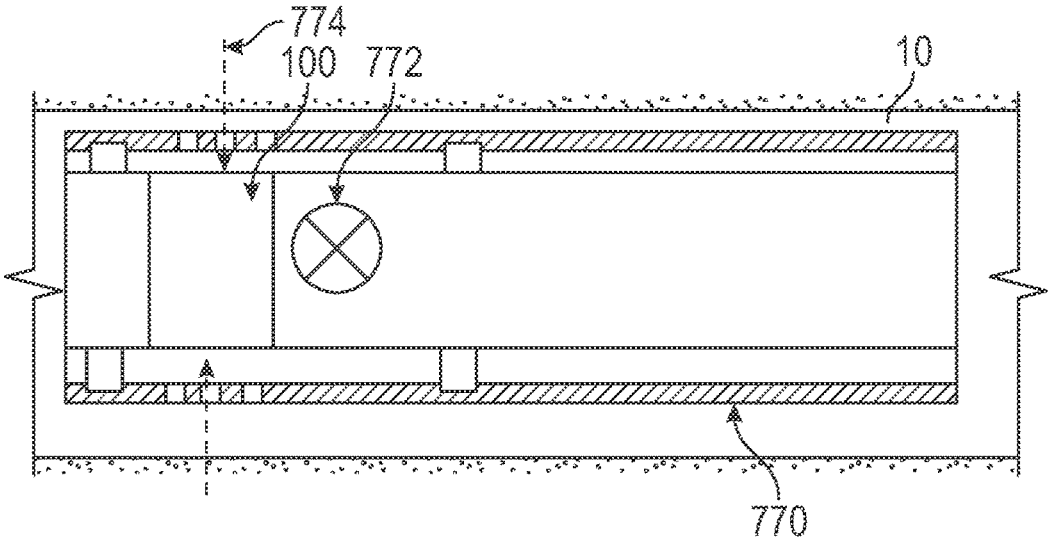
FIG. 13 schematically illustrates a motor according to the present disclosure that provides power for a valve used in a production well.

Referring now to FIG. 13, there is shown a production well structure 770 that includes a valve assembly 772 that may be positioned along a wellbore 10. The valve assembly 772 may be used to control fluid inflow 774 from a formation surrounding the wellbore 10. In one arrangement, a motor 100 may be used to actuate the valve assembly 772. For example, if a composition, such as water cut, of the flowing fluid 774 is outside of a desired range, the motor 100 may be actuated to adjust the valve assembly 772 accordingly. As noted previously, the motor 100 may include a passage to accommodate the flow of fluid, such as production fluid. It should be understood that the valve assembly 772 is merely illustrative of any downhole power consumer that may be used with the production well structure 770.

From the above, it should be appreciated that motors according to the present disclosure can be configured to supply mechanical power to power consumers that may have operating limitations such as: susceptibility to magnetic fields and permanent magnets, high-level vibration at high ambient temperature, and/or low RPM and high toque. Motors according to the present disclosure may be readily adapted to satisfy such operating limitations. Additionally, motors according to the present disclosure may provide a hollow central area for either tools or components or to accommodate fluid flow. Further, motors according to the present disclosure may not require the use of a gearbox, or other speed/torque converter, and may be configured to have a relatively small diameter.

While the foregoing disclosure is directed to the one mode embodiments of the disclosure, various modifications will be apparent to those skilled in the art. It is intended that all variations be embraced by the foregoing disclosure. In particular, while the present disclosure has been described in the context of energizing downhole tools, those skilled in the art will readily appreciate that the teachings of the present disclosure may be advantageously used to energy any type or form of tool, regardless of location or field of industrial use. Thus, any tools requiring mechanical power to rotate, extend, contract, compress, or otherwise manipulate one or more objects during operation may be energized by motors according to the present disclosure.

We claim:

1. An apparatus for providing mechanical power, comprising:

at least one actuator configured to vibrate along a first axis, the vibrations varying a dimension of the at least one actuator as measured along the first axis;

at least one passive member configured to rotate around a second axis that is substantially parallel to the first axis; and at least one pushing member positioned between the at least one actuator and the at least one passive member, the at least one pushing member being fixed to the at least one actuator and having a contact surface frictionally engaging and applying a mechanical force to the at least one passive member, wherein the frictional engagement generates a frictional force that resists relative movement between the at least one pushing member and the at least one passive member and generates a tangential force that acts on a moment arm of the second axis around which the passive member rotates.

2. The apparatus of claim 1, wherein the at least one actuator includes at least one piezoelectric element and wherein the vibrations are at one resonant frequency of a plurality of resonant frequencies of the at least one actuator.

3. An apparatus for providing mechanical power, comprising:

at least one actuator configured to vibrate along a first axis, the vibrations varying a dimension of the at least one actuator as measured along the first axis;

at least one passive member configured to rotate around a second axis that is substantially parallel to the first axis; and at least one pushing member positioned between the at least one actuator and the at least one passive member, the at least one pushing member being fixed to the at least one actuator and having a contact surface frictionally engaging and applying a mechanical force to the at least one passive member, wherein the at least one passive member has an outer circumferential surface and a contact face that is non-parallel to the first axis, and wherein the at least one pushing member contacts the face at a location radially inward of the outer circumferential surface.

4. The apparatus of claim 1, wherein the at least one pushing member has an asymmetric rigidity along the first axis.

5. The apparatus of claim 1, wherein the at least one pushing member includes at least one plate.

6. The apparatus of claim 1, wherein the at least one pushing member has a pre-formed bent portion, and wherein movement of the at least one pushing member toward the at least one passive member increases a bend of the pre-formed bent portion.

7. The apparatus of claim 1, wherein the at least one pushing member includes a plurality of plates, and wherein at least one plate of the plurality of plates is thicker than the other plates.

8. The apparatus of claim 1, further comprising a passage aligned with the first axis, and wherein the at least one actuator includes a plurality of piezoelectric elements circumferentially distributed around the passage.

9. The apparatus of claim 8, wherein the passage is one of: (i) a flow bore through which fluid flows, and (ii) a cavity for housing a downhole tool.

10. The apparatus of claim 1, wherein the at least one actuator includes a plurality of actuators.

11. The apparatus of claim 10, further comprising a power consumer being connected and receiving mechanical power from all of the plurality of actuators.

12. The apparatus of claim 10, wherein at least one actuator of the plurality of actuators causes rotation of the at least one passive member in a direction opposite to at least one of the other actuators.

13. The apparatus of claim 1, further comprising a pressure applicator configured to selectively compress the least one pushing member.

14. A method for providing mechanical power, comprising:

forming a motor that includes:

an actuator configured to vibrate along a first axis, the vibrations varying a dimension of the at least one actuator as measured along the first axis, at least one passive member configured to rotate around a second axis that is substantially parallel to the first axis, and at least one pushing member positioned between the at least one actuator and the at least one passive member, the at least one pushing member being fixed to the at least one actuator and having a contact surface frictionally engaging and applying a mechanical force to the at least one passive member, wherein the frictional engagement generates a frictional force that resists relative movement between the at least one pushing member and the at least one passive member and generates a tangential force that acts on a moment arm of the second axis around which the passive member rotates;

conveying the motor and a power consumer into a wellbore; and supplying mechanical power to the power consumer using the motor.

15. The method of claim 14, wherein the at least one pushing member has an asymmetric rigidity along the first axis, wherein the at least one passive member has an outer circumferential surface and a contact face that is non-parallel to the first axis, and wherein the at least one pushing member contacts the face at a location radially inward of the outer circumferential surface.

* * * * *